United States Patent [19]

Monacelli

[11] 4,211,351

[45] Jul. 8, 1980

[54] MAGAZINE MEMBER FOR HOLDING FASTENING STAPLES AND THE LIKE

[76] Inventor: Umberto Monacelli, Via Parini 6, Monza (Milan), Italy

[21] Appl. No.: 967,257

[22] Filed: Dec. 5, 1978

[30] Foreign Application Priority Data

Dec. 13, 1977 [IT] Italy ..... 23010/77[U]

[51] Int. Cl.[2] ..... B25C 5/16

[52] U.S. Cl. ..... 227/120; 206/340

[58] Field of Search ..... 206/340, 341; 227/120, 227/127, 128, 132, 146

[56] References Cited

U.S. PATENT DOCUMENTS

| | | | |
|---|---|---|---|
| 2,361,483 | 10/1944 | Lang | 227/132 |
| 3,612,380 | 10/1971 | Kuhlman | 227/120 |
| 3,640,443 | 2/1972 | Itagaki | 227/120 |
| 4,109,844 | 8/1978 | Becht | 227/120 |
| 4,119,258 | 10/1978 | Ewig, Jr. | 227/132 |

*Primary Examiner*—Paul A. Bell

*Attorney, Agent, or Firm*—Haseltine, Lake & Waters

[57] ABSTRACT

In a pistol-grip tool for driving tacks, staples and the like, the improvement consisting in that the guiding bench for the staples to be ejected and driven is made partly of a moulded plastics material and partly of metal insets. The central portion or core of the guiding bench is of properly shaped plastics material, the insets are placed at both ends of the bench and are solidly embedded in the plastics material by a single molding stroke so as to form an entity. The entire structure is lightweight without giving up robustness and wear resistance in the points in which these properties are vital.

4 Claims, 5 Drawing Figures

MAGAZINE MEMBER FOR HOLDING FASTENING STAPLES AND THE LIKE

It is known that the automatic machines intended to be used for driving fasteners such as metal staples, tacks and the like have provisions for holding an orderly succession of members in a row-like array, the latter being sequentially pushed under the driving punch.

More particularly, in the machines having the form of pistol-grip tools, which are generally actuated by pressurized air, there is a guideway structure which receives a certain number of members to be driven into position, thrust by a slider so as to have the first member of the row in registry with the ejection and driving area.

Such pistol-grip tools have a number of typical functional requirements to be fulfilled, among which there are light weight and robustness so as to withstand even rough handling. They are provided, more particularly, with a cast body which affords a grip and a seat for the ejection mechanism: perpendicularly to this seat a feed channel for the fasteners to be driven is positioned, which is called a guiding bench. The present invention is more particularly concerned with said guiding bench.

This bench is generally formed by a bent metal sheet with an abutment welded to its head portion, where it affords one half of the space of the ejection runway.

It is suggested, now, to embody the guiding bench in the form of a composite structure which has proven to afford considerable advantages both under the point of view of the properties of the bench and of those of the pistol-grip stapling tool as a whole.

According to the invention, the guiding bench which carries drivable fasteners as defined above comprises a central portion of a plastics material which is a guideway for the fasteners arranged in an orderly row-like array and also for the pusher member, the ends of such central portions having, secured thereto, a first metal inset which provides a portion of the ejection runway, and a second metal inset on which means for holding the guiding bench in position within the pistol-grip tool are active.

In order that the objects and the features of this invention may be better understood, an exemplary embodiment thereof will be described hereinafter and illustrated in the accompanying drawings, wherein.

Figures 1, 2, 3, 4, 5:
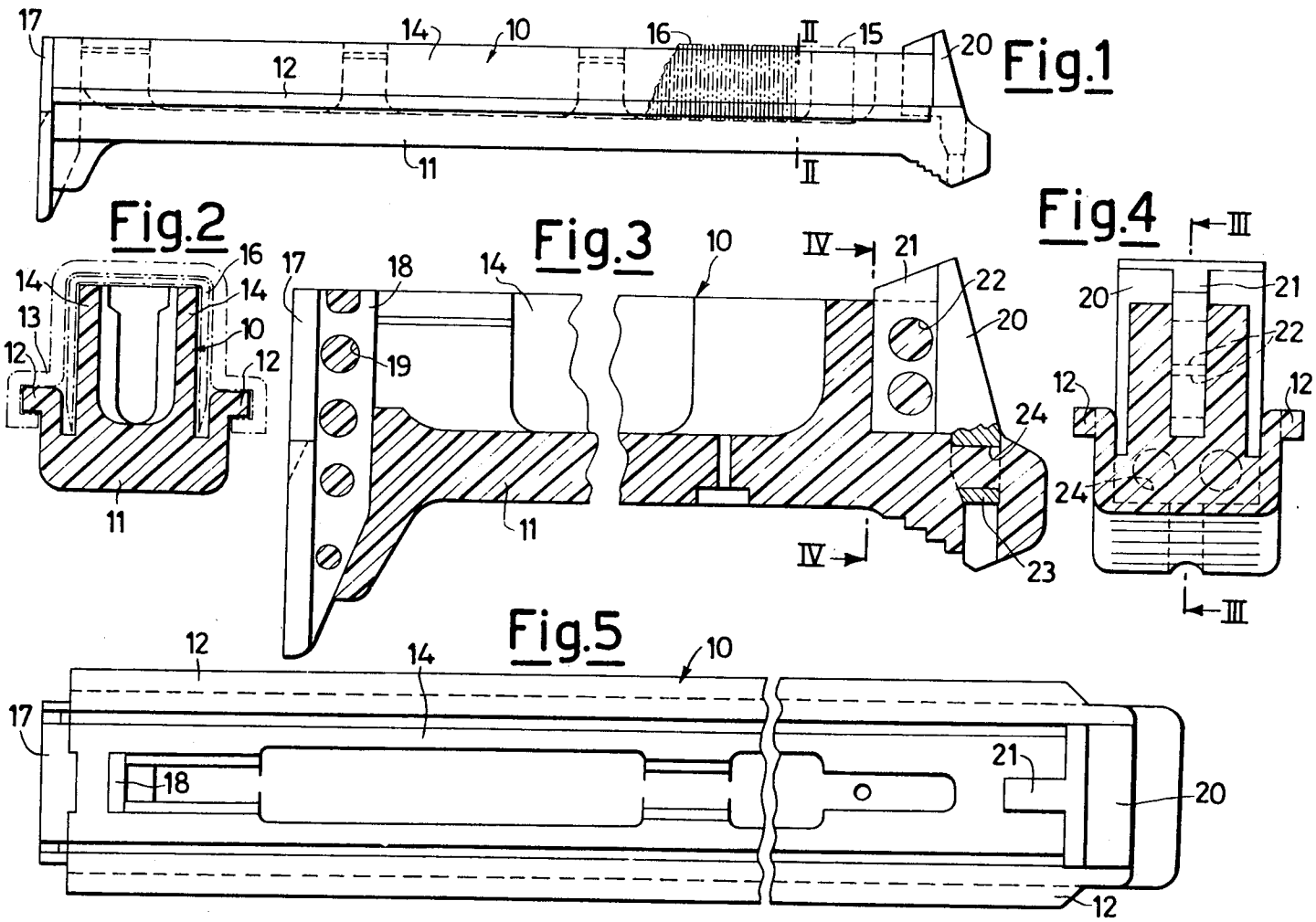
FIG. 1 is a side elevational view of a guiding bench according to this invention.
FIG. 2 is a cross-sectional view taken along the line II—II of FIG. 1.
FIG. 3 is a cross-sectional view taken along the line III—III of FIG. 4.
FIG. 4 is a cross-sectional view taken along the line IV—IV of FIG. 3.
FIG. 5 is a top plan view.

FIG. 1 shows a guiding bench suitable for a conventional pistol-grip driving tool, such as for example, described in previous patents by the same Applicant hereof. The guiding bench is composed by a channel-like central portion 10, having a base 11 equipped with webs 12 for slidably engaging a complementary guideway in the tool, the guideway being indicated at 13 in dash-and-dot lines.

From the base 11 projects a hollow rib 14 intended slidably to support a slider symbolized at 15, the latter pushing an array of fasteners 16 to be driven, under the bias of a spring which can be received in the internal hollow space of the rib 14.

Characteristically, and according to the invention, the portion 10 is made of a plastics material and carried at its front end, a metal inset 17, which is intended to provide a portion of the ejection runway for the fasteners 16, the front shape of said runway being wholly conventional. In the rear position, conversely, the inset 17 has a rib 18, through which bores 19 are provided, and which is embedded in the plastics material which forms the portion 10. The presence of the bores 19 affords a stable and reliable hold of the inset 17 so as to withstand any mechanical action during the use of the tool.

At the rear of the guiding bench is fastened, in quite similar a fashion, a tail metallic inset 20, which is likewise fastened by embedding a rib 21 having perforations 22 within the plastics material mass, an additional portion 23, having perforations 24 therethrough, being similarly embedded. The external portion of the inset 20 withstands the action of the bench-retaining members which action would be such as to bring about too quick a wear of plastics material component parts.

One of the principal advantages afforded by the structure of this invention lies in the very light weight and the ease of manufacture. The entire assembly can be prepared by a single moulding stroke, the insets 17 and 20 being previously inserted in the mould for 10, and then embedded in 10.

It has been seen, furthermore, that to embody the guiding bench according to the structural outline of the invention has a not negligible and favourable bearing on the noise caused by the tool since it reduces such noise and does away with uncontrollable resonance ripples in the bench during the ejection and driving of the staples.

Obviously, the particular configuration of the bench and its size are a function of the size of the relevant seat in the tool and the form and the size of the fasteners to be ejected and driven.

Appropriate changes of shape of the previously described component parts lie within the scope of this invention.

I claim:

1. A pistol-grip driving tool employing a bench for guiding an array of fasteners to be driven, such as metal staples; including: an ejection runway; a bench-retaining means; said bench being further defined by a central portion and first and second end portions, said central portion being of a plastic material and forming a guideway for row-like arranged fasteners being acted upon by a pusher; said first end portion comprising a first metal inset adapted to form a wall portion of said ejection runway, and said second end portion comprising a second metal inset, adapted for engagement by said bench-retaining means.

2. A pistol-grip driving tool having a bench according to claim 1, wherein: said metallic insets have extensions embedded in the plastic material of said central portion.

3. A pistol-grip driving tool having a bench according to claim 2, wherein: said extensions include uppercut portions for anchoring said insets to said plastic material.

4. A pistol-grip driving tool having a bench according to claim 3, wherein: said uppercut portions are through-bores formed through said extensions.

* * * * *